US006189578B1

(12) United States Patent
Clüsserath

(10) Patent No.: US 6,189,578 B1
(45) Date of Patent: Feb. 20, 2001

(54) FILLING SYSTEM AND FILLING ELEMENT

(75) Inventor: Ludwig Clüsserath, Bad Kreuznach (DE)

(73) Assignee: KHS Maschinen- und Anlagenbau AG, Dortmund (DE)

( * ) Notice: Under 35 U.S.C. 154(b), the term of this patent shall be extended for 0 days.

(21) Appl. No.: 09/300,015

(22) Filed: Apr. 27, 1999

(30) Foreign Application Priority Data

Apr. 27, 1998 (DE) ..... 198 18 762

(51) Int. Cl.[7] ..... B65B 31/00; B67C 3/00

(52) U.S. Cl. ..... 141/7; 141/4; 141/5; 141/6; 141/40; 141/44; 141/45; 141/46; 141/48; 141/49; 141/50; 141/57; 141/59; 141/293; 141/302; 141/305

(58) Field of Search ..... 141/39, 40, 44, 141/45–50, 54, 56, 57, 59, 63, 285, 293, 302, 305, 307, 4–7; 53/268, 276

(56) References Cited

U.S. PATENT DOCUMENTS 5,301,488 * 4/1994 Ruhl et al. ..... 53/55
5,501,253 * 3/1996 Weiss ..... 141/40

* cited by examiner

*Primary Examiner*—Timothy L. Maust
(74) *Attorney, Agent, or Firm*—Nils H. Ljungman & Associates

(57) ABSTRACT

A filling system for filling bottles or similar containers with a liquid product under counter pressure has a plurality of filling elements. Each filling element has a liquid valve for the controlled dispensing of the product as well as a plurality of gas ducts realized in a housing, by means of which ducts at least three separate and individually controlled control valves for each filling element can be controlled so that a wide variety of processes can be conducted for the bottling of the product, and namely merely by varying the actuation of the control valves or by varying a corresponding program for a microprocessor-assisted or computer-assisted control device.

20 Claims, 4 Drawing Sheets

FILLING SYSTEM AND FILLING ELEMENT

BACKGROUND OF THE INVENTION

Field of the Invention

The present invention relates to a filling system to fill bottles or similar containers with a liquid product under counter pressure, and to a filling element.

OBJECT OF THE INVENTION

Filling systems or bottling machines and the filling elements used in such systems or machines are known in a wide variety of realizations. The object of the invention is to create a filling system and a filling element suitable for such a system that has a simplified construction and can be used very universally.

SUMMARY OF THE INVENTION

The present invention discloses a filling system and a filling element. The filling system being to fill bottles or similar containers with a liquid product under counter pressure, whereby, in at least one embodiment, chronologically prior to the actual filling phase, the interior of the container can be pre-pressurized with an inert gas under pressure, for example $CO_2$ gas, and during the filling phase, the gas displaced from the container by the incoming product can be contained under pressure by a return gas collecting space. Chronologically subsequent to the filling phase, the container can be depressurized to atmospheric pressure by means of a depressurization duct. The filling system having at least one filling element, with a liquid duct that is realized in a housing of the filling element. This liquid duct can form a dispensing opening for the product and emerge above a filling tube that projects beyond an underside of the filling element. A fluid valve, in the liquid duct, can open during the filling phase to fill the respective container fastened with its container mouth to the filling element and close again at the end of the filling phase. A gas duct, when the container is fastened to the filling element, can be in communication with the interior of the container by means of at least one gas duct opening that can be offset with respect to the filling tube. Also, there can be first, second and third individually controllable control valves to control gas pathways that are realized in the housing, wherein, a first control valve can be in communication on the input side by means of a first gas pathway with an area of the liquid duct downstream of the liquid valve in the direction of flow of the product, and on the output side with a second gas pathway. A second control valve can be in communication on the input side by means of a third gas pathway with a source for the inert gas under pressure. A third control valve can be in communication on the input side by means of a third gas pathway with the gas duct, and with a fourth gas pathway that has at least a first throttle for the depressurization, and can be in communication on the output side by means of a fifth gas pathway that has at least one second throttle with the return gas collecting space. Further, in a sixth gas pathway that connects the first control valve on the output side with the third control valve on the input side, there can be a first check valve that opens in one direction of flow from the third control valve to the first control valve, and closes for a flow in the opposite direction. Further, in a gas pathway or bypass parallel to the at least one second throttle or nozzle there can be a second check valve that opens in one direction of flow from the return gas collecting space to the third control valve and closes for a flow in the opposite direction.

The filling element of the present invention, being to fill bottles or similar containers with a liquid product under counter pressure, whereby, in at least one embodiment, chronologically prior to the actual filling phase, the interior of the container can be pre-pressurized with an inert gas under pressure, for example $CO_2$ gas, and during the filling phase, the gas displaced from the container by the incoming product can be contained under pressure by a return gas collecting space. Chronologically subsequent to the filling phase, the container can be depressurized to atmospheric pressure by means of a depressurization duct. The filling element being at least one filling element. A liquid duct is realized in a housing of each filling element. This liquid duct can form a dispensing opening for the product and emerge above a filling tube that projects beyond an underside of the filling element. A liquid valve in the liquid duct can open in the filling phase to fill the respective container placed with a container mouth on the filling element and close again at the end of the filling phase. A gas duct, when the container is fastened to the filling element, can be in communication with the interior of the container by means of at least one gas duct opening that is offset with respect to the filling tube. There can be first, second and third individually controllable control valves to control gas pathways that are realized in the housing, whereby a first control valve can be in communication on the input side by means of a first gas pathway with an area of the liquid duct downstream of the liquid valve in the direction of flow of the product, and on the output side with a second gas pathway. A second control valve can be in communication on the input side by means of a third gas pathway with a source for the inert gas under pressure. A third control valve can be in communication on the input side by means of a third gas pathway with the gas duct and with a fourth gas pathway that has at least a first throttle for the depressurization, and is in communication on the output side by means of a fifth gas pathway that has at least one second throttle with the return gas collecting space, whereby in a sixth gas pathway which can connect the first control valve on the output side with the third control valve there can be a first check valve which opens in a direction of flow from the third control valve to the first control valve, and closes for a flow in the opposite direction. Further, in a gas pathway or bypass parallel to the at least one second throttle or nozzle there can be a second check valve, which opens in a direction of flow from the return gas collecting chamber to the third control valve, and closes for a flow in the opposite direction.

The present invention makes it possible, merely by modifying the actuation of the individual control valves that are provided separately for each filling element and can be actuated individually, i.e. merely by modifying a program of an associated electrical control device, to perform a wide variety of filling processes that are optimally suited to the respective products being bottled. The advantageous refinements of the present invention are set out in the features and claims included hereinbelow.

In other words, in at least one embodiment of the present invention, by modify the actuation of the individual valves at one or more filling element, a wide variety of filling products and/or bottle types can be filled. For example, this can be accomplished by modifying or choosing one or more programs in a computer-assisted control device, for example, programs stored or entered into a computer. It can be possible to modify the actuating and control of different valves located at the filling elements of the bottling machine, in accordance with the filling product and/or bottle type being used. For example, in at least one embodiment, the timing, order and/or length of actuation or deactuation of the liquid valve, the control valves and/or check valves, can be individually controlled to make it possible to perform a wide variety of different filling processes, and to accommodate thereby for a variety of different filling products and corresponding bottle types and sizes. The individual control of some or all of the valves allows the inventive filling system, and each filling element, to be used for a variety of different filling products, requiring different filling processes. By way of example, in at least one embodiment of the invention, different filling elements on the same bottling machine could possibly be controlled by the control device to perform different filling processes, or, alternatively, all of the filling elements could be controlled to perform the same filling process for a certain period of time, and then to switch to another filling process, depending upon the product or bottle type to be used. It is also within the scope of at least one embodiment of the present invention that different filling elements can have different filling arrangements, including possibly varying the valve arrangements or numbers and ducts, for example.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

At least one embodiment of the invention is explained in greater detail below with reference to the accompanying figures, in which.

DESCRIPTION OF THE PREFERRED EMBODIMENT

Figure 1:
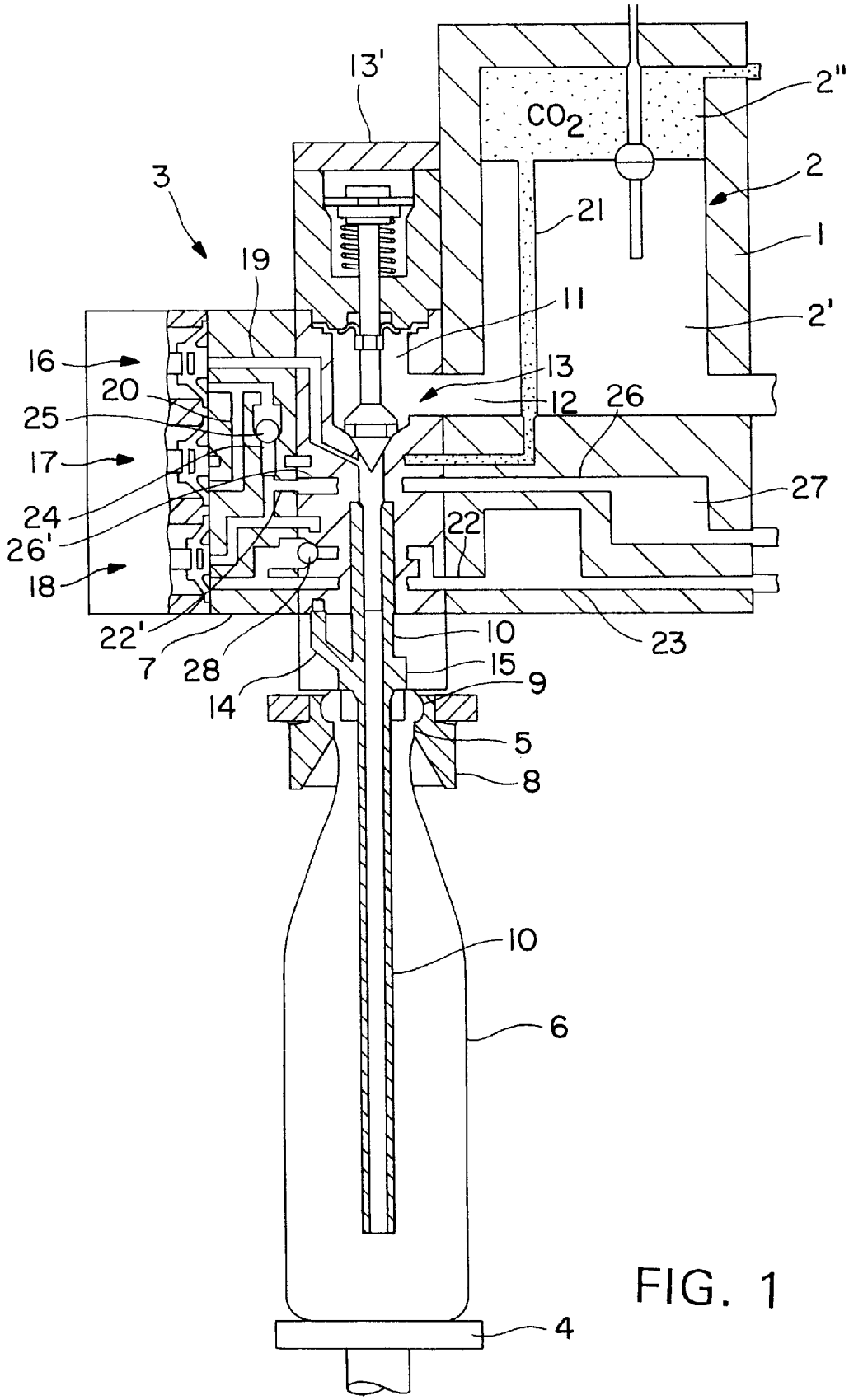
FIG. 1 is a simplified illustration in vertical section of one of the possible filling elements of a filling machine of the rotating design, together with a container in the form of a bottle fastened to the filling element.
Figure 2:
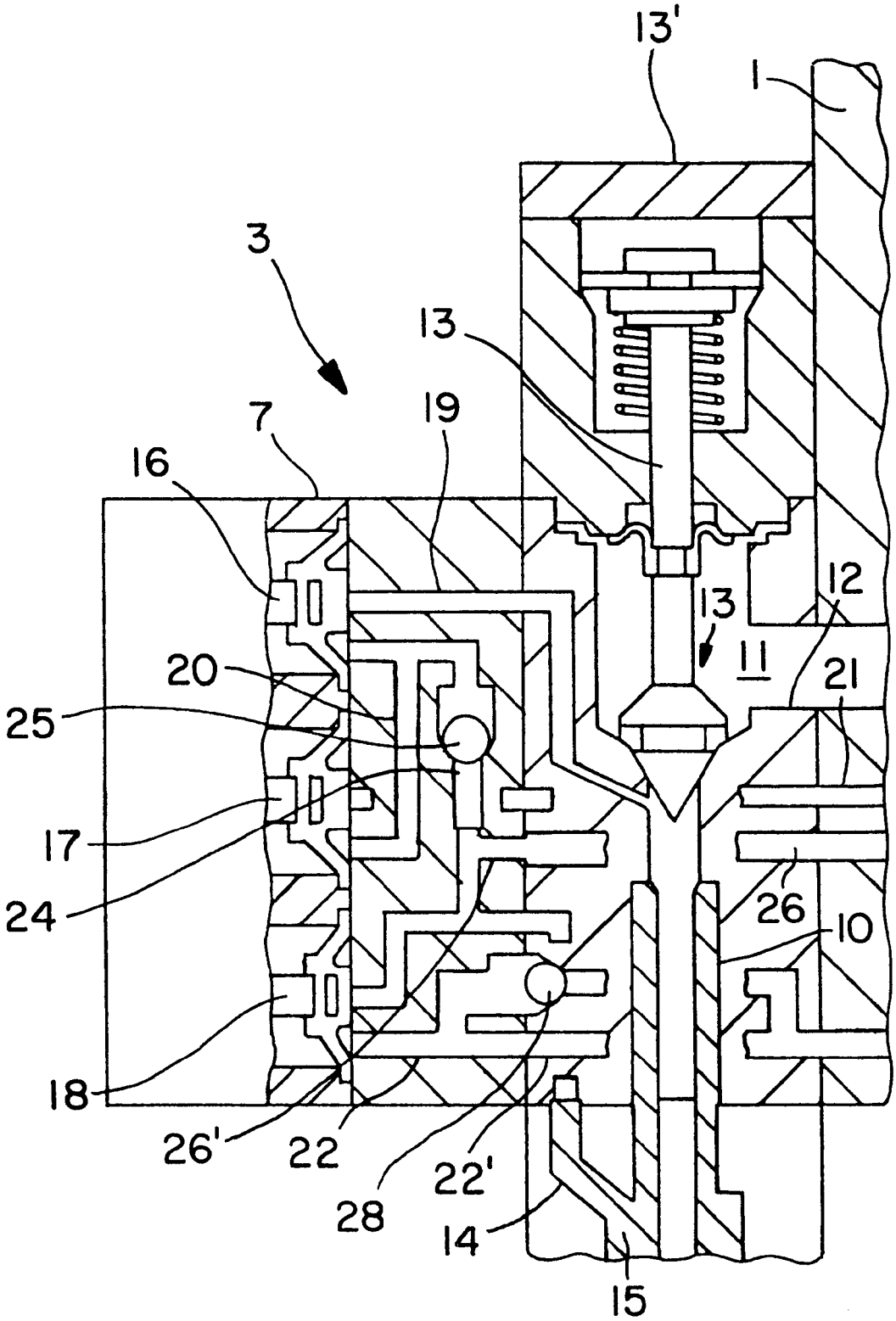
FIG. 2 is an enlarged detail of the filling element illustrated in FIG. 1.

In the figures, 1 is the toroidal bowl of the filling machine, which as in the known art can be a component of the rotor of this machine, which rotor rotates around the vertical axis of the machine. During the operation of this filling machine, the interior 2 of the toroidal bowl 1 is filled in a controlled manner with the liquid product (beverage) up to a specified level N, so that in the interior 2 there is a liquid space 2' that is occupied by the liquid product, and above that a gas space 2" that holds an inert gas, for example $CO_2$ gas, at a specified or controlled filling pressure.

On the periphery of the toroidal bowl 1, distributed at uniform angular intervals, there are filling elements 3, each of which, together with a vertically movable bottle support 4, forms a filling site, in particular to fill the bottle 6 that is standing with its base on the bottle support 4, and is pressed by the bottle support 4 with its mouth 5 in a sealed position against the filling element 3.

The filling elements 3 can be realized in the form of long tube filling elements and have a filling tube 10 that extends beyond the underside of the filling element housing 7 or beyond the centering element 8 located there with a seal, which filling tube 10, when the container 6 is fastened to the filling element 3, extends into the interior of this container 6 to the vicinity of the bottom of the container 6. In the housing 7, there is a liquid duct 11, the one end of which is in connection by means of a passage 12 with the liquid space 2'. The other end of the liquid duct 11 is in communication in the interior of the housing 7 with the upper, open end of the filling tube 10. The liquid valve 13, formed by a valve body with a tappet, is also provided in the liquid duct 11, which liquid valve 13 is actuated by means of the tappet by means of a pneumatic actuator device 13'.

Also formed in the housing 7 is, among other things, a gas duct 14 that makes a transition on the underside of the housing 7 into a ring-shaped opening 15 that concentrically surrounds the filling tube 10, by means of which opening 15 the gas duct 14 is in communication with the interior of the bottle 6 when the bottle 6 is pressed against the filling element 3 with an externally tight seal. The filling element 3 also has three individually actuated pneumatic control valves 16, 17 and 18, which can be connected as follows:

Control valve 16

Input side: by means of the duct 19 with the liquid duct 11, and namely in the area between the liquid valve 13 and the filling tube 10, i.e. in the direction of flow of the product toward the liquid valve 13.

Output side: with a duct 20.

Control valve 17

Input side: with a duct 21 that is in communication with the gas space.

Output side: with the duct 20.

Control valve 18

Input side: with the gas duct 14.

Output side: with a duct 22 that leads to a toroidal gas duct 23 realized in the toroidal bowl 1, which gas duct, during the operation of the filling machine, contains the return gas at a regulated pressure and from which excess return gas is regulated or released in a controlled manner.

In the housing 7, there is also a duct 24 that extends between the duct 20 and the gas duct 14, and in which there is a check valve 25, namely such that this check valve 25 closes for a flow in the direction from the duct 20 into the gas duct 14, but opens for a flow in the opposite direction. A duct 26 is also in direct communication with the gas duct 14, and emerges in a toroidal space or toroidal duct 27 also realized in the toroidal bowl 1. In the duct 22, there is a nozzle or throttle identified as 22'. There is an additional nozzle or throttle 26' in the duct 26. Parallel to the throttle or nozzle 22', there is a check valve 28 which acts as a bypass for the nozzle 22' and closes in the direction of flow to the return gas duct 23, but opens in the opposite direction.

One advantage of the filling system and filling element 3 described above is that as a result of the novel realization, in particular also with regard to the control valves 16–18, the realization and connection of the internal ducts, and realizations of the nozzles and the check valve, a wide variety of processes can be used to fill containers or bottles 6. That is, merely by an appropriate selection of the actuation, or of the software for the control of the fluid valve 13 and the control valves 16–18, a wide variety of processes are possible, among other things:

single-chamber filling principle three-chamber filling principle preliminary flushing of the respective bottle 6 via the filling tube 10 partial preliminary flushing from the return gas duct 23 preliminary pressurization via the bottle neck or the gas duct 14 preliminary pressurization by means of the filling tube 10 high-speed and low-speed filling phases controlled preliminary depressurization equalization of level between the level of product in the bottle and in the filling tube during preliminary depressurization (in particular for the bottling of champagne).

For the above mentioned preliminary pressurization via the filling tube, there is a check valve 25 in the connecting duct 24. If the preliminary pressurization is performed via the neck of the bottle, i.e. via the gas duct 14, this check valve 25 is deactivated, namely by removal or extraction of the valve seat.

The following examples explain in additional detail some of the process variants that are possible using the filling system claimed by the invention.

I. Process variant with preliminary pressurization via the filling tube

This process variant comprises the following basic features in particular:

Three-chamber filling principle

Preliminary pressurization via the filling tube

Controlled preliminary depressurization

Partial preliminary pressurization from the return gas duct

Low-speed and high-speed filling phases

Filling level correction.

This process variant is suitable in particular for top fermented and bottom fermented beers up to approximately 6.0 gr $CO_2$/liter, for wheat beers up to approximately 9.0 gr $CO_2$/liter, as well as for oxygen-sensitive soft drinks. This process variant is also particularly well suited for filling bottles 6 made of plastic (PET bottles), in which pre-evacuation cannot be used as a method for low-oxygen bottling on account of the insufficient shape stability of the bottles in a vacuum.

Table I below lists the individual process steps and the positions of the liquid valve 13 and of the control valves 16–18 during these process steps, whereby the control valves are in their closed position, unless it is expressly mentioned that the control valve in question is in the open position.

TABLE I

| Process Step | Position of the Control Valves 16–18 | Position of the Liquid Valve 13 |
|---|---|---|
| Pre-flushing of bottle 6 with $CO_2$<br>When the bottle 6 is raised by means of the bottle support 4 to the filling element 3, it is already flushed with $CO_2$ from the gas space 2" of the toroidal bowl. | Valve 16 open<br>Valve 17 open | Valve 13 closed |

TABLE I-continued

| Process Step | Position of the Control Valves 16–18 | Position of the Liquid Valve 13 |
|---|---|---|
| Some of the air is thereby displaced from the interior of the bottle 6. | | |
| Partial preliminary pressurization from the return gas duct 23 via the opening check valve 28 and the gas duct 14<br>The $CO_2$ that is discharged into the return gas duct during the actual filling is reused in this process step, as a result of which the $CO_2$ consumption is reduced. | Valve 18 open | Valve 13 closed |
| Preliminary Pressurization with $CO_2$ from gas space 2" via the filling tube 10<br>A practically pure $CO_2$ atmosphere is established in the interior of the filling tube 10 and in the lower portion of the bottle 6 immediately before filling begins | Valve 16 open<br>Valve 17 open | Valve 13 closed |
| Slow initial filling (initial<br>The product enters slowly and with few bubbles from the filling tube 10 and strikes the bottom of the bottle. The slow filling continues until the end of the filling tube is immersed in the product.<br>All the control valves 16–18 are closed. The gas flows via the nozzle 26' into the depressurization duct 27. | | Valve 13 open |
| High-speed filling<br>As a result of high speeds of admission into the non-critical, generally cylindrical part of the bottle, a high filling capacity is achieved.<br>The gas flows via the nozzles 22' and 26' into the corresponding toroidal ducts 23 and 27 respectively. | Valve 18 open | Valve 13 closed |
| Braking and Correcting Filling<br>In the tapered neck of the bottle, the filling speed is reduced to the value of the startup filling phase. The level of product with a smooth surface reaches the probe (not shown) provided on the filling tube 10, and results in a closing of the filling valve 13 when the product has reached the correct filling height. The gas from the bottle flows via the nozzle 26' into the depressurization duct 27. | | Valve 13 open |
| End of filling and subsequent preliminary depressurization and calming to return gas pressure<br>The pressure inside the bottle 6 decreases to the pressure level of the return gas duct 23. At this pressure level, there is a rapid degasification and calming of the product. Enclosed bubbles rise to the surface of the product without significant foaming. | Valve 18 open | Valve 13 closed |

TABLE I-continued

| Process Step | Position of the Control Valves 16–18 | Position of the Liquid Valve 13 |
|---|---|---|
| The pressure is reduced via the nozzles 22' and 26', and is finally maintained at the return gas pressure via the opened control valve 18. | | |
| Final depressurization into the depressurization duct 27 | | Valve 13 closed |
| With the control valves 16–18 closed and the filling valve 13 closed, the final depressurization takes place via the nozzle 26' | | |
| Empty filling tube 10 and lower bottle 6 | Valve 16 open | Valve 13 closed |

II Process Variant with Preliminary Pressurization via the Neck of the Bottle or the Gas Duct 14

This process variant comprises the following basic features in particular:

Single-chamber filling principle

Preliminary pressurization via the neck of the bottle

Controlled preliminary depressurization

Partial preliminary pressurization from the return gas duct

Low-speed and high-speed filling phases

This process variant is suitable in particular for bottling oxygen-sensitive soft drinks, for the combined bottling of beer and soft drinks, as well as of juices and soft drinks.

This process is particularly well suited, however, for low-oxygen bottling in bottles 6 made of plastic (PET bottles), for which a pre-evacuation for low-oxygen bottling is not possible, on account of the insufficient shape stability of the bottles in a vacuum.

Table II below the individual process steps and the positions of the liquid valve 13 as well as of the control valves 16–18 in these process steps, whereby the control valves are in their closed position, unless it is expressly indicated that the control valve in question is in the open position.

TABLE II

| Process Step | Position of the Control Valves 16–18 | Position of the Liquid Valve 13 |
|---|---|---|
| Raise bottle 6 and fasten to filling element | | Valve 13 closed |
| Partial preliminary pressurization from the return gas duct 23 via the opening check valve 28 and the gas duct 14 | Valve 18 open | Valve 13 closed |
| The $CO_2$ that is discharged into the return gas duct during the actual filling is reused in this process step, as a result of which the $CO_2$ consumption is reduced. | | |
| Preliminary pressurization with $CO_2$ from gas space 2" | Valve 17 open | Valve 13 closed |
| This preliminary pressurization is accomplished via the ducts 14, 21 and 24, via the open valve 17 and the opening check valve 25. | | |
| Slow initial filling (initial filling phase) | | Valve 13 open |
| The product enters slowly and with few bubbles from the filling tube 10 and strikes the bottom of the bottle. The slow filling continues until the end of the filling tube is immersed in the product. | | |
| High-speed filling | Valve 17 open | Valve 13 open |
| As a result of high speeds of admission into the non-critical, generally cylindrical part of the bottle, a high filling capacity is achieved. The filling speed results essentially from the static liquid level in the toroidal bowl 1 (single-chamber filling principle). The gas flows unthrottled back into the gas space 2". | | |
| Braking and Correcting Filling | | Valve 13 open |
| In the tapered neck of the bottle, the filling speed is reduced to the value of the startup filling phase. The level of product with a smooth surface reaches the probe (not shown) provided on: the filling tube 10, and results in a closing of the filling valve 13 when the product has reached the correct filling height. The gas from the bottle flows via the nozzle 26' into the depressurization duct 27. | | |
| End of filling and subsequent preliminary depressurization and calming to return gas pressure | Valve 18 open | Valve 13 closed |
| The pressure inside the bottle 6 decreases to the pres-- sure level of the return gas duct 23. At this pressure lever, there is a rapid degasification and calming of the product. Enclosed bubbles rise to the surface of the product without significant foaming. | | |
| The pressure is reduced via the nozzles 22' and 26', and is finally maintained at the return gas pressure via the opened control valve 18. | | |
| Final depressurization into the depressurization duct 27 | | Valve 13 closed |
| With the control valves 16–18 closed and the filling valve 13 closed, the final depressurization takes place via the nozzle 26'. There is a throttled decrease of the internal bottle pressure to atmospheric pressure. There are no splattering losses on account of the low output pressure. | | |
| Empty filling tube 10 and lower bottle 6 | Valve 16 open | Valve 13 closed |
| The product in the filling tube 10 flows back into the filling tube when the bottle | | |

TABLE II-continued

| Process Step | Position of the Control Valves 16–18 | Position of the Liquid Valve 13 |
|---|---|---|
| is lowered. | | |

III Process Variant for Bottling Champagne

This process variant comprises the following basic features in particular:

Single-chamber filling principle

Preliminary pressurization via the neck of the bottle

Controlled preliminary depressurization

Partial preliminary pressurization from the return gas duct

Equalization of level between filling tube 10 and neck of bottle under return gas pressure Low-speed and high-speed filling phases This process variant is particularly well suited for bottling champagne and foaming beverages, as well as cooler beverages.

Table III below presents the individual process steps and the positions of the liquid valve 13 as well as of the control valves 16–18 in these process steps, whereby the control valves are in their closed position, unless it is expressly indicated that the control valve in question is in the open position.

TABLE III

| Process Step | Position of the Control Valves 16–18 | Position of the Liquid Valve 13 |
|---|---|---|
| Raise bottle 6 and fasten to filling element | | Valve 13 closed |
| Partial preliminary pressurization from the return gas duct 23 via the opening check valve 28 and the gas The $CO_2$ that is discharged into the return gas duct during the actual filling is reused in this process step, as a result of which the $CO_2$ consumption is reduced. | Valve 18 open | Valve 13 closed |
| Preliminary pressurization from gas space 2" This preliminary pressurization is accomplished via the ducts 14, 21 and 24, via the open valve 17 and the opening check valve 25. | Valve 17 open | Valve 13 closed |
| Slow initial filling (initial filling phase) The product enters slowly and with few bubbles from the filling tube 10 and strikes the bottom of the bottle. The slow filling continues until the end of the filling tube is immersed in the product. | | Valve 13 open |
| High-speed filling As a result of high speeds of admission into the non-critical, generally cylindrical part of the bottle, a high filling capacity is achieved. The filling speed results essentially from the static liquid level in the toroidal bowl 1 (single-chamber filling principle) . The gas flows unthrottled back into the gas space 2". | Valve 17 open | Valve 13 closed |
| Braking and Correcting Filling In the tapered neck of the bottle, the filling speed is reduced to the value of the startup filling phase. The level of product with a smooth surface reaches the probe (not shown) provided on the filling tube 10, and results in a closing of the filling valve 13 when the product has reached the correct filling height. The gas from the bottle flows via the nozzle 26' into the depressurization duct 27. | | Valve 13 open |
| End of filling and subsequent preliminary depressurization and calming to return gas pressure The pressure inside the bottie 6 decreases to the pressure level of the return gas duct 23. At this pressure lever, there is a rapid degasification and calming of the product. Enclosed bubbles rise to the surface of the product without significant foaming. The pressure is reduced via the nozzles 22' and 26', and is finally maintained at the return gas pressure via the opened control valve 18. | Valve 18 open | Valve 13 closed |
| Equalization of levels in the filling tube 10 and in the bottle 6 under return gas pressure In this process step, any $CO_2$ that is released in the filling tube 10 can be discharged upward. An ejection of the product from the filling tube 10 by degasification of $CO_2$ and expanding gas is prevented. | Valve 16 open Valve 18 open | Valve 13 closed |
| Final depressurization into the depressurization duct 27 With the control valves 16–18 closed and the filling valve 13 closed, the final depressurization takes place via tbe nozzle 26'. There is a throttled decrease of the internal bottle pressure to atmospheric pressure. | | Valve 13 closed |
| Empty filling tube 10 and lower bottle 6 The product in the filling tube 10 flows back into the filling tube when the bottle is lowered. | Valve 16 open | Valve 13 closed |

The invention was explained above on the basis of one exemplary embodiment. It is apparent and intended that numerous variations and modifications can be made without thereby going beyond the teaching of the invention.

Figure 3:
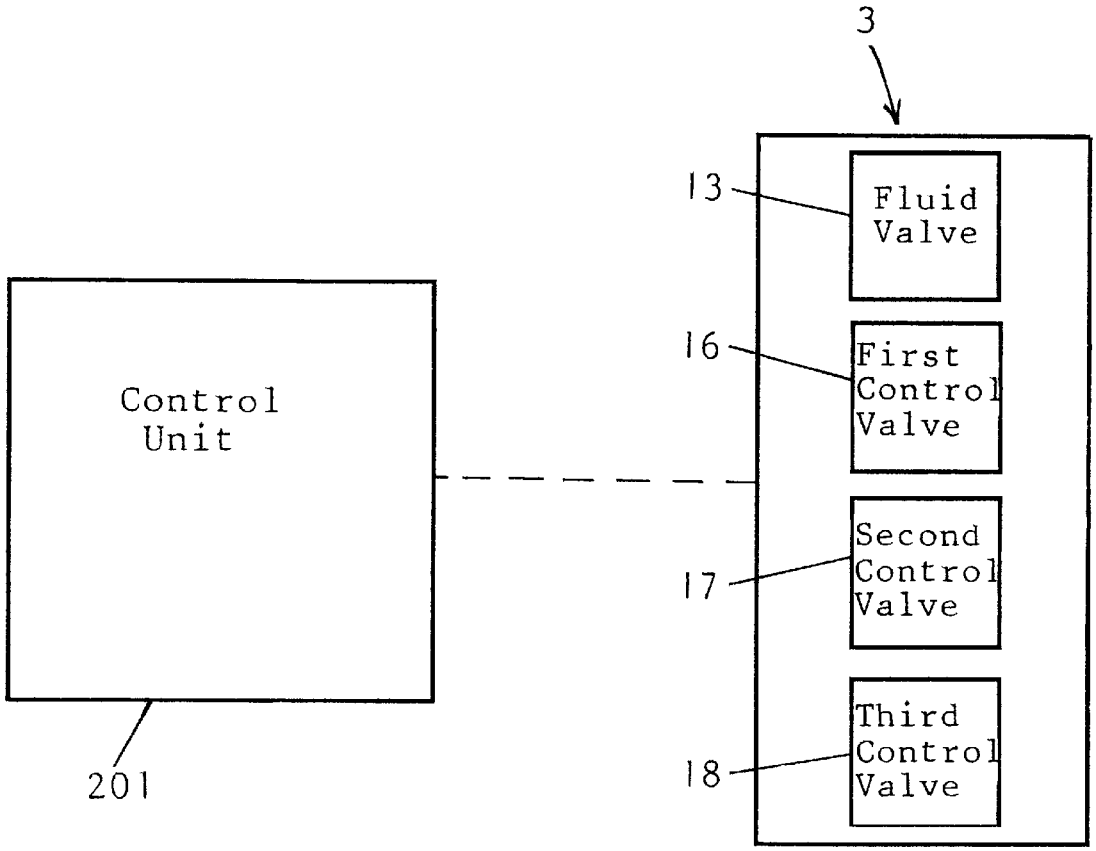
FIG. 3 is a box diagram showing schematically a control unit operatively connected to a filling element.

FIG. 3 is a box diagram showing schematically at least one embodiment of the present invention, in which a control unit 201, is operatively connected to the filling elements 3. This control unit can be an electronic control device, such as a microprocessor-assisted or computer-assisted control device to control, for example, the actuation of the valves located at each filling element 3. In at least one emodiment, this control unit can control the functioning of a fluid valve 13, and control valves 16, 17, 18. Additional functioning can also potentially be performed and controlled by the control unit 201, for example, in at least one embodiment, a variety of control, check or fluid valves could also be controlled by the control unit 201.

Figure 4:
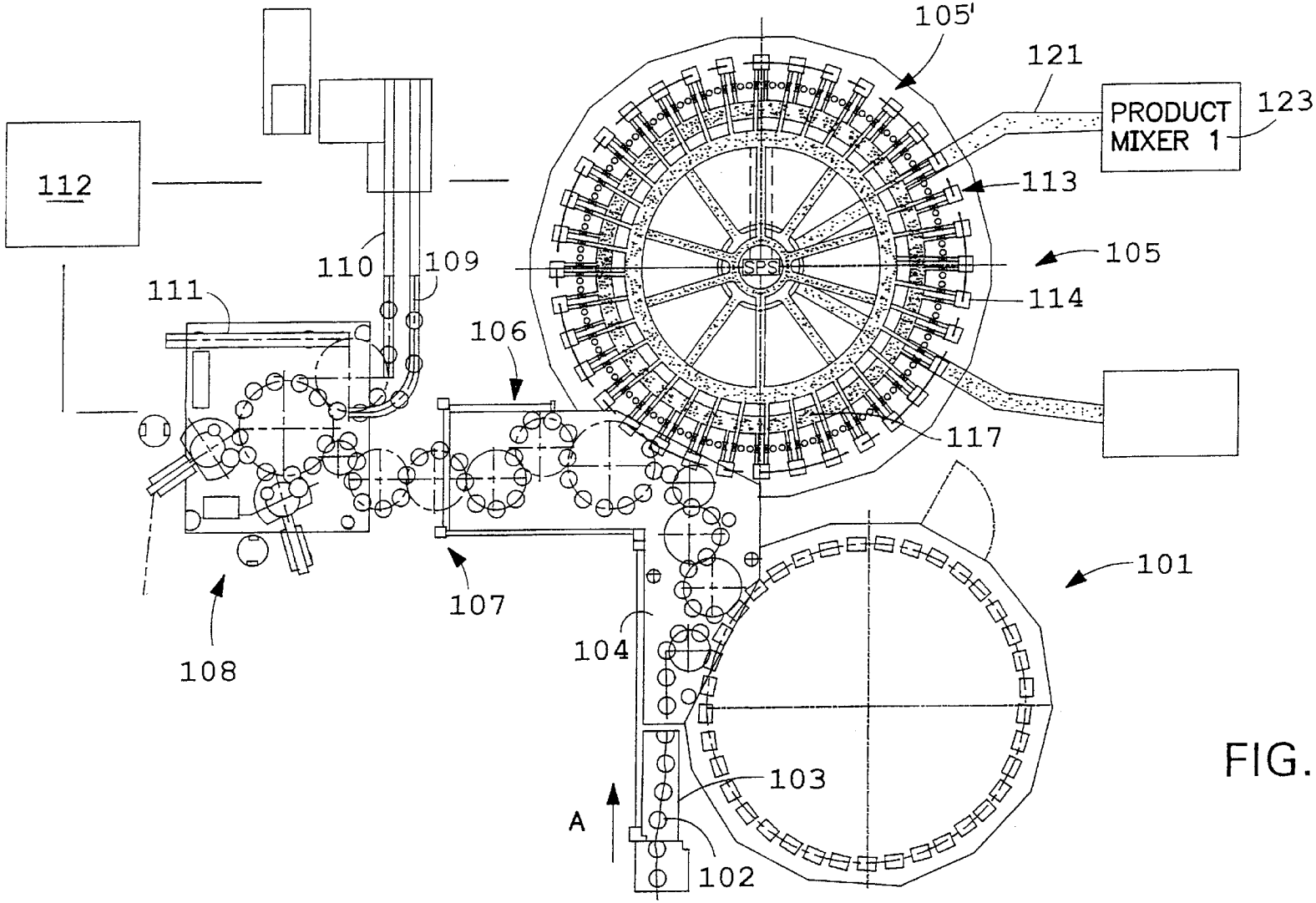
FIG. 4 shows a simplified overhead view of a system for the simultaneous filling, closing and subsequent labelling of containers, namely bottles, with which the present invention might be utilized.

FIG. 4 shows one example of a system for filling containers which could possibly utilize the present invention. FIG. 4 shows a rinser 101, to which the containers, namely bottles 102, are fed in the direction indicated by the arrow A by means of a conveyor line 103, and downstream of which, in the direction of travel, the rinsed bottles 102 are transported by means of a conveyor line 104 formed by a star wheel conveyor to a filling machine 105 or its inlet star wheel. Downstream of the filling machine 105, in the direction of travel of the bottles 102, there can preferably be a closer 106 which closes the bottles 102. The closer 106 can be connected directly to a labelling device 108 by means of a conveyor line 107 formed by a plurality of star wheel conveyors. In the illustrated embodiment, the labelling machine has three outputs, namely one output formed by a conveyor 109 for bottles 102 which are filled with a first product, and are then labelled corresponding to this product, a second output formed by a conveyor 110 for those bottles 102 which are filled with a second product and are then labelled corresponding to this product, and a third output formed by a conveyor 111 which removes any bottles 102 which have been incorrectly labelled.

In FIG. 4, 112 is a central electronic control device which includes a process controller which, among other things, controls the operation of the above-referenced system.

The filling machine 105 is preferably of the revolving design, with a rotor 105' which revolves around a vertical machine axis. On the periphery of the rotor 105' there are a number of filling positions 113, each of which consists of bottle carriers or container carriers (not shown), as well as a filling element 114 located above the respective container carrier. The toroidal vessel 117 is a component of the revolving rotor 105'. The toroidal vessel 117 can be connected by means of a rotary coupling and by means of an external connecting line 121 to an external reservoir or mixer 123 to supply the product.

As well as the more typical filling machines having one toroidal vessel, it is possible that in at least one possible embodiment of the present invention a filling machine could possibly be utilized wherein each filling element 114 is preferably connected by means of two connections to a toroidal vessel 117 which contains a first product (by means of a first connection) and to a second toroidal vessel which contains a second product (by means of the second connection). In this case, each filling element 114 can also preferably have, at the connections, two individually-controllable fluid or control valves, so that in each bottle 102 which is delivered at the inlet of the filling machine 105 to a filling position 113, the first product or the second product can be filled by means of an appropriate control of the filling product or fluid valves.

One feature of the invention resides broadly in the filling system to fill bottles or similar containers 6 with a liquid product under counter pressure, whereby, chronologically prior to the actual filling phase, the interior of the container 6 is pre-pressurized with an inert gas under pressure, for example $CO_2$ gas, and during the filling phase, the gas displaced from the container 6 by the incoming product is contained under pressure by a return gas collecting space 23, and chronologically subsequent to the filling phase, the container is depressurized to atmospheric pressure by means of a depressurization duct, with at least one filling element 3, with a liquid duct 11 that is realized in a housing 7 of the filling element 3, which liquid duct forms a dispensing opening for the product and emerges above a filling tube 10 that projects beyond an underside of the filling element 3. with a fluid valve 13 in the liquid duct 11, which valve opens during the filling phase to fill the respective container 6 fastened with its container mouth 5 to the filling element 3 and closes again at the end of the filling phase, with a gas duct 14 that, when the container is fastened to the filling element, is in communication with the interior of the container 6 by means of at least one gas duct opening 15 that is offset with respect to the filling tube 1, with first, second and third individually controllable control valves 16, 17, 18 to control gas pathways that are realized in the housing 7, whereby a first control valve 16 is in communication on the input side by means of a first gas pathway 19 with an area of the liquid duct 11 downstream of the liquid valve 13 in the direction of flow of the product, and on the output side with a second gas pathway 20, a second control valve 17 is in communication on the input side by means of a third gas pathway 21 with a source 2" for the inert gas under pressure, a third control valve 18 is in communication on the input side by means of a third gas pathway 21 with the gas duct 4 and with a fourth gas pathway 26 that has at least a first throttle 26' for the depressurization, and is in communication on the output side by means of a fifth gas pathway that has at least one second throttle 22' with the return gas collecting space 23, whereby in a sixth gas pathway 24 that connects the first control valve 16 on the output side with the third control valve 18 on the input side, there is a first check valve 25 that opens in one direction of flow from the third control valve 18 to the first control valve 16, and closes for a flow in the opposite direction, and whereby in a gas pathway or bypass parallel to the at least one second throttle or nozzle 22' there is a second check valve 28 that opens in one direction of flow from the return gas collecting space 23 to the third control valve 18 and closes for a flow in the opposite direction.

Another feature of the invention resides broadly in the filling system characterized by the fact that the source for the inert gas under pressure is a gas space 2" that is formed in the interior 2 of a bowl 1 that supplies the product to the filling element 3, namely above a liquid space 2' that is occupied by the product.

Yet another feature of the invention resides broadly in the filling system characterized by the fact that the filling system is a filling machine of the revolving or rotating type with a plurality of filler elements 3 for the liquid product provided on a rotor or toroidal bowl 1.

Still another feature of the invention resides broadly in the system characterized by the fact that the at least one first check valve 25 can be switched to the inactive position or can be removed to provide for an opening of the sixth gas pathway 24 in both directions of flow.

A further feature of the invention resides broadly in the system characterized by the fact that the return gas collecting space is a toroidal duct 23.

Another feature of the invention resides broadly in the system characterized by the fact that the fourth gas pathway 26 emerges into a space, for example in a toroidal duct 27, that is in communication with the atmosphere.

Yet another feature of the invention resides broadly in the system characterized by a control device, preferably a computer-assisted or microprocessor-assisted control device for the individual control of the liquid valve 13 and of the control valves 16–18 of each filling element 3.

Still another feature of the invention resides broadly in the system characterized by the fact that the control device opens the first and the second control valves 16, 17 for a preliminary flushing of the respective container 6 chronologically prior to the actual filling phase and to the pre-pressurization from the source 2" for the inert gas under pressure, with the liquid valve 13 closed and the third control valve 18 closed.

A further feature of the invention resides broadly in the system characterized by the fact that the control device opens the third control valve 18 for a partial pre-pressurization of the respective container 6 chronologically prior to the actual filling phase by means of the gas duct 14 and the gas opening 15 from the return gas collecting space 23, with the liquid valve 13 closed and the first and second control valves 16, 17 closed.

Another feature of the invention resides broadly in the system characterized by the fact that the control device opens the first control valve 16 and the second control valve 17 for a preliminary pressurization of the container 6 from the source 2" for the inert gas via the filling tube 10 with the liquid valve 13 closed and the third control valve 18 closed.

Yet another feature of the invention resides broadly in the system characterized by the fact that the control device opens the third control valve 18 for a preliminary pressurization of the container 6 via the gas duct 14 and the gas duct opening 15 from the source 2" for the inert gas, with the liquid valve 13 closed, and the first and second control valves 16, 17 closed.

Still another feature of the invention resides broadly in the system characterized by the fact that the control device opens the third control valve 18 in a preliminary depressurization and/or calming phase that chronologically follows the filling phase, with a closed liquid valve 13 as well as closed first and second control valves 16, 17.

A further feature of the invention resides broadly in the system characterized by the fact that the control device opens the first control valve 16 at the end of the filling to empty the filling tube 10 into the respective container 4, with a closed liquid valve 13 as well as closed second and third control valves 17, 18.

Another feature of the invention resides broadly in the system characterized by the fact that the control device for an equalization of the levels in the filling tube 10 and in the container 6, still under return gas pressure but after the completion of the filling phase, opens the first and third control valves 16, 17 with the liquid valve 13 closed and the second control valve 17 closed.

Yet another feature of the invention resides broadly in the filling element to fill bottles or similar containers 6 with a liquid product under counter pressure, whereby chronologically prior to the actual filling phase, the interior of the container 6 is pre-pressurized with an inert gas under pressure, for example $CO_2$ gas, and during the filling phase, the gas displaced from the container 6 by the incoming product is contained under pressure by a return gas collecting space 23, and chronologically subsequent to the filling phase, the container is depressurized to atmospheric pressure by means of a depressurization duct, with at least one filling element 3, with a liquid duct 11 realized in a housing 7 of the filling element 3, which liquid duct forms a dispensing opening for the product and emerges above a filling tube 10 that projects beyond an underside of the filling element 3, with a liquid valve 13 in the liquid duct 11 which opens in the filling phase to fill the respective container 6 placed with a container mouth 5 on the filling element 3 and closes again at the end of the filling phase, with a gas duct 14 that, when the container is fastened to the filling element, is in communication with the interior of the container 6 by means of at least one gas duct opening 15 that is offset with respect to the filling tube 1, with first, second and third individually controllable control valves 16, 17, 18 to control gas pathways that are realized in the housing 7, whereby a first control valve 16 is in communication on the input side by means of a first gas pathway 19 with an area of the liquid duct 11 downstream of the liquid valve 13 in the direction of flow of the product, and on the output side with a second gas pathway 20, a second control valve 17 is in communication on the input side by means of a third gas pathway 21 with a source 2" for the inert gas under pressure, a third control valve 18 is in communication on the input side by means of a third gas pathway 21 with the gas duct 4 and with a fourth gas pathway 26 that has at least a first throttle 26' for the depressurization, and is in communication on the output side by means of a fifth gas pathway that has at least one second throttle 22' with the return gas collecting space 23, whereby in a sixth gas pathway 24 which connects the first control valve 16 on the output side with the third control valve 18 there is a first check valve 25 which opens in a direction of flow from the third control valve 18 to the first control valve 16, and closes for a flow in the opposite direction, and whereby in a gas pathway or bypass parallel to the at least one second throttle or nozzle 22' there is a second check valve 28, which opens in a direction of flow from the return gas collecting chamber 23 to the third control valve 18, and closes for a flow in the opposite direction.

Still another feature of the invention resides broadly in the filling element characterized by the fact that the at least one first check valve 25 can be switched so that it is inactive or removed to open the sixth gas pathway 24 in both directions of flow.

U.S. Pat. No. 4,135,699, issued Jan. 23, 1979 to Petzsch et al., which may contain valves or valve components which may be used in embodiments of the present invention, is hereby incorporated by reference as if set forth in its entirety herein.

U.S. Pat. No. 5,713,403, issued Feb. 3, 1998 to Clüsserath et al., which may contain a rotary bottling machine as well as valves or valve components which may be used in at least one embodiment of the present invention, is hereby incorporated by reference as if set forth in its entirety herein.

U.S. Pat. No. 5,634,500 issued Jun. 3, 1997 to Clüsserath et al., which may contain valves or valve components which may be used in at least one embodiment of the present invention, is hereby incorporated by reference as if set forth in its entirety herein.

Examples of container filling machines and components thereof which may be used in accordance with embodiments of the present invention, may be found in the following U.S. patents: U.S. Pat. No. 5,413,153, issued May 9, 1995; U.S. Pat. No. 5,558,138, issued Sep. 24, 1996; and U.S. Pat. No. 5,713,403, issued Feb. 3, 1998.

Examples of bottling systems, which may be used in or with embodiments of the present invention, may be found in the following U.S. patents, which are hereby incorporated by reference, as if set forth in their entirety herein: U.S. Pat. No. 5,634,500, issued on Jun. 3, 1997 and entitled "Method for Bottling a Liquid in Bottles or Similar Containers"; U.S. Pat. No. 5,558,138, issued Sep. 24, 1996 and entitled "Process and Apparatus for Cleaning Container Handling Machines Such as Beverage Can Filling Machines"; and U.S. Pat. No. 5,713,403, issued Feb. 3, 1998 and entitled "Method and System for Filling Containers with a Liquid Filling Product, and Filling Machine and Labelling Device for Use with this Method or System". All of the above U.S. patent documents in this paragraph are assigned to KHS Maschinen- und Anlagenbau Aktiengesellschaft of the Federal Republic of Germany.

Examples of container labelling and/or filling machines and components thereof and/or accessories therefor which may be used in embodiments of the present invention, may be found in the following documents, which are hereby incorporated by reference, as if set forth in their entirety herein: U.S. Pat. No. 4,944,830 issued on Jul. 31, 1990 and entitled "Machine for Labelling Bottles"; U.S. Pat. No. 4,911,285 issued on Mar. 27, 1990 and entitled "Drive for a Rotary Plate in a Labelling Machine for Bottles"; U.S. Pat. No. 4,976,803 issued on Dec. 11, 1990 and entitled "Apparatus for Pressing Foil on Containers, Such As on the Tops & the Necks of Bottles or the Like; U.S. Pat. No. 4,950,350 issued on Aug. 21, 1990 and entitled "Machine for Labelling Bottles or the Like"; U.S. Pat. No. 5,017,261 issued on May 21, 1991 and entitled "Labelling Machine for Objects Such as Bottles or the Like"; U.S. Pat. No. 5,062,917 issued on Nov. 5, 1991 and entitled "Support Element for the Followers of a Cam Drive of a Drive Mechanism & a Labelling Station Equipped With a Support Element"; U.S. Pat. No. 4,981,547 issued on Jan. 1, 1991 and entitled "Mounting & Drive Coupling for the Extracting Element Support of a Labelling Station for a Labelling Machine for Containers and Similar Objects"; U.S. Pat. No. 5,004,518 issued on Apr. 2, 1991 and entitled "Labelling Machine for Objects such as Bottles or the Like"; U.S. Pat. No. 5,078,826 issued on Jan. 7, 1992 and entitled "Labelling Machine for the Labelling of Containers"; U.S. Pat. No. 5,062,918 issued on Nov. 5, 1991 and entitled "Glue Segments which can be Attachable to a Drive Shaft of a Labelling Machine"; U.S. Pat. No. 5,227,005 and issued on Jul. 13, 1993 and entitled "Labelling Station for Labelling Objects, Such as Bottles"; U.S. Pat. No. 5,087,317 issued on Feb. 11, 1992 and entitled "Labelling Machines for the Labelling of Container"; U.S. Pat. No. 5,129,984 issued on Jul. 14, 1992 and entitled "Bottle Labelling Machine"; U.S. Pat. No. 5,185,053 issued on Feb. 9, 1993 and entitled "Brushing Station for a Labelling Machine for Labelling Bottles & the Like"; U.S. Pat. No. 5,075,123 issued on Dec. 24, 1991 and entitled "Process & Apparatus for Removing Alcohol From Beverages"; U.S. Pat. No. 5,217,538 issued on Jun. 8, 1993 and entitled "Apparatus & Related Method for the Removal of Labels & Foil Tags Adhering to Containers, in Particular, to Bottles"; U.S. Pat. No. 5,174,851 issued on Dec. 29, 1992 and entitled "Labelling Machine for Labelling Containers, Such as Bottles"; U.S. Pat. No. 5,110,402 issued on May 5, 1992 and entitled "Labelling Machine for Labelling Containers Such as Bottles Having a Labelling Box for a Stack of Labels in a Labelling Station"; U.S. Pat. No. 5,167,755 issued on Dec. 1, 1992 and entitled "Adhesive Scraper Which Can be Adjusted in Relation to an Adhesive Roller in a Labelling Machine"; U.S. Pat. No. 5,413,153 issued on May 9, 1995 and entitled "A Container Filling Machine for Filling Open-Top Containers, & A Filler Valve Therefor"; U.S. Pat. No. 5,569,353, issued on Oct. 29, 1996 and entitled "Labelling Machine & Apparatus for the Automatic Loading of the Main Magazine of a Labelling Machine, & A Supply Magazine Which Can Be Used in Such an Apparatus". All of the above U.S. patent documents in this paragraph are assigned to KHS Maschinen- und Anlagenbau Aktiengesellschaft of the Federal Republic of Germany.

Some additional examples of container filling systems, valves or methods and their components which may be incorporated in an embodiment of the present invention may be found in U.S. Pat. No. 5,425,402, issued on Jun. 20, 1995 and entitled "Bottling System with Mass Filling and Capping Arrays"; U.S. Pat. No. 5,450,882, issued on Sep. 19, 1995 and entitled "Beverage Dispensing Apparatus and Process"; U.S. Pat. No. 5,377,726, issued on Jan. 3, 1995 and entitled "Arrangement for Filling Bottles or Similar Containers"; U.S. Pat. No. 5,402,833, issued on Apr. 4, 1995 and entitled "Apparatus for Filling Bottles or Similar Containers"; U.S. Pat. No. 5,445,194, issued on Aug. 29, 1995 and entitled "Filling Element for Filling Machines for Dispensing a Liquid Filling Material into Containers." As well as, U.S. Pat. No. 5,241,996, issued to W. Heckmann et al. on Sep. 7, 1993; U.S. Pat. No. 5,190,084 issued to E. Diehl, et al. on Mar. 2, 1993, U.S. Pat. No. 5,195,331, issued to B. Zimmern, et al. on Mar. 23, 1993; U.S. Pat. No. 5,209,274, issued to R. La Warre on May 11, 1993; U.S. Pat. No. 5,217,680 issued to M. Koshiishi on Jun. 8, 1993; and U.S. Pat. No. 5,219,405 issued to W. Weiss on Jun. 15, 1993.

Some additional examples of methods and apparatuses for closing bottles and containers and their components which may be incorporated in an embodiment of the present invention may be found in U.S. Pat. No. 5,402,623, issued on Apr. 4, 1995, and entitled "Method and Apparatus for Closing Bottles"; U.S. Pat. No. 5,473,855, issued on Dec. 12, 1995 and entitled "System for Installing Closures on Containers"; U.S. Pat. No. 5,447,246, issued on Sep. 5, 1995 and entitled "Methods and Combinations for Sealing Corked Bottles"; U.S. Pat. No. 5,425,402, issued on Jun. 20, 1995 and entitled "Bottling System with Mass Filling and Capping Arrays"; U.S. Pat. No. 5,398,485, issued on Mar. 21, 1995, and entitled "Bottle Support Mechanism for a Capping Machine"; U.S. Pat. No. 5,419,094, issued on May 30, 1995 and entitled "Constant Speed Spindles for Rotary Capping Machine"; and U.S. Pat. No. 5,449,080, issued on Sep. 12, 1995 and entitled "Methods and Combinations for Sealing Corked Bottles."

U.S. patent application Ser. No. 09/299,497, filed on or about Apr. 26, 1999, having the inventor Ludwig Clüsserath, and claiming priority from Federal Republic of Germany Patent Application No. 198 18761.0 which was filed on Apr. 27, 1998, and DE-OS 198 18 761.0 and DE-PS 198 18 761.0, are hereby incorporated by reference as if set forth in their entirety herein.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 198 18 762.9, filed on Apr. 27, 1998, having inventor Ludwig Clüsserath, and DE-OS 198 18 762.9 and DE-PS 198 18 762.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

At Least Partial Nomenclature

1 Toroidal bowl
2 Interior of toroidal bowl
2' Liquid space
2" Gas space
3 Filling element
4 Bottle turntable
5 Mouth of bottle
6 Bottle
7 Filling element housing
8 Centering element
9 Gasket
10 Filling tube
11 Liquid duct
12 Passage
13 Liquid valve
13' Actuator element
14 Gas duct
15 Opening
16–18 Control valve
19–22 Duct
22' Nozzle
23 Toroidal duct (return gas duct)
24 Duct
25 Check valve
26 Duct
26' Nozzle
27 Toroidal duct (depressurization duct)
28 Check valve

What is claimed is:

1. A method for filling containers with liquid filling products utilizing a filling machine having a revolving construction with a plurality of filling positions for filling the containers with the filling product on the periphery of a rotor which revolves around a vertical machine axis, each of the filling positions having a filling element and a container carrier, each of the filling elements comprising a plurality of valves and ducts for filling containers with a liquid product, utilizing a filling system to fill containers with a liquid product under counter pressure, wherein, chronologically prior to the actual filling phase, the interior of the container is pre-pressurized with an inert gas under pressure, and during the filling phase, the gas displaced from the container by the incoming product is contained under pressure by a return gas collecting space, and chronologically subsequent to the filling phase, the container is depressurized to atmospheric pressure by means of a depressurization duct, said filling system comprising:

at least one filling element;

a liquid duct that is realized in a housing of the filling element, which liquid duct forms a dispensing opening for the product and emerges above a filling tube that projects beyond an underside of the filling element;

a fluid valve in the liquid duct, which valve opens during the filling phase to fill the respective container fastened with its container mouth to the filling element and closes again at the end of the filling phase;

a gas duct that, when the container is fastened to the filling element, is in communication with the interior of the container by means of at least one gas duct opening that is offset with respect to the filling tube;

first, second and third individually controllable control valves to control gas pathways that are realized in the housing, wherein: a first control valve is in communication on an input side by means of a first gas pathway with an area of the liquid duct downstream of the liquid valve in the direction of flow of the product, and on an output side with a second gas pathway;

a second control valve is in communication on the input side by means of a third gas pathway with a source for the inert gas under pressure;

a third control valve is in communication on the input side by means of a third gas pathway with the gas duct and with a fourth gas pathway that has at least a first throttle for the depressurization, and is in communication on the output side by means of a fifth gas pathway that has at least one second throttle with the return gas collecting space;

wherein in a sixth gas pathway that connects the first control valve on the output side with the third control valve on the input side, there is a first check valve that opens in one direction of flow from the third control valve to the first control valve, and closes for a flow in the opposite direction; and wherein in a gas pathway or bypass parallel to the at least one second throttle or nozzle there is a second check valve that opens in one direction of flow from the return gas collecting space to the third control valve and closes for a flow in the opposite direction; and said method comprising the steps of:

determining a desired filling product and container type to be filled;

feeding the containers into a filling machine;

moving each container into one of the plurality of filling positions;

entering data into a control device, the data including at least one of:

the liquid filling product to be utilized, and the type of container being filled, to determine a filling process;

defining with the filling process the operation of the plurality of valves of at least one of the filling positions to achieve the determined filling process; and controlling with the control device the operation of the plurality of valves, to fill the containers in accordance with the determined filling process.

2. A filling system to fill containers with a liquid product under counter pressure, wherein, chronologically prior to the actual filling phase, the interior of the container is pre-pressurized with an inert gas under pressure, and during the filling phase, the gas displaced from the container by the incoming product is contained under pressure by a return gas collecting space, and chronologically subsequent to the filling phase, the container is depressurized to atmospheric pressure by means of a depressurization duct, said filling system comprising:

at least one filling element;

a liquid duct that is realized in a housing of the filling element, which liquid duct forms a dispensing opening for the product and emerges above a filling tube that projects beyond an underside of the filling element;

a fluid valve in the liquid duct, which valve opens during the filling phase to fill the respective container fastened with its container mouth to the filling element and closes again at the end of the filling phase;

a gas duct that, when the container is fastened to the filling element, is in communication with the interior of the container by means of at least one gas duct opening that is offset with respect to the filling tube;

first, second and third individually controllable control valves to control gas pathways that are realized in the housing, wherein: a first control valve is in communication on an input side by means of a first gas pathway with an area of the liquid duct downstream of the liquid valve in the direction of flow of the product, and on an output side with a second gas pathway, a second control valve is in communication on the input side by means of a third gas pathway with a source for the inert gas under pressure, a third control valve is in communication on the input side by means of a third gas pathway with the gas duct and with a fourth gas pathway that has at least a first throttle for the depressurization, and is in communication on the output side by means of a fifth gas pathway that has at least one second throttle with the return gas collecting space;

wherein in a sixth gas pathway that connects the first control valve on the output side with the third control valve on the input side, there is a first check valve that opens in one direction of flow from the third control valve to the first control valve, and closes for a flow in the opposite direction, and wherein in a gas pathway or bypass parallel to the at least one second throttle or nozzle there is a second check valve that opens in one direction of flow from the return gas collecting space to the third control valve and closes for a flow in the opposite direction.

3. The system according to claim 2, wherein the filling system is a filling machine of the revolving or rotating type with a plurality of filler elements for the liquid product provided on a rotor or toroidal bowl.

4. The system according to claim 2, wherein the source for the inert gas under pressure is a gas space that is formed in the interior of a bowl that supplies the product to the filling element, which gas space is disposed above a liquid space that is occupied by the product.

5. The system according to claim 4, wherein the at least one first check valve is configured to be at least one of: switched to the inactive position and can be removed, to provide for an opening of the sixth gas pathway in both directions of flow.

6. The system according to claim 4, wherein:

the return gas collecting space is a toroidal duct; and the fourth gas pathway emerges into a space that is in communication with the atmosphere.

7. The system according to claim 4, wherein the filling system is a filling machine of the revolving or rotating type with a plurality of filler elements for the liquid product provided on a rotor or toroidal bowl.

8. The system according to claim 7 wherein the at least one first check valve can be at least one of: switched to the inactive position and removed, to provide for an opening of the sixth gas pathway in both directions of flow.

9. The system according to claim 8, wherein the return gas collecting space is a toroidal duct.

10. The system according to claim 9, wherein the fourth gas pathway emerges into a space that is in communication with the atmosphere.

11. The system according to claim 10, further comprising:

a control device;

said control device being at least one of a computer-assisted control device and a microprocessor-assisted control device, for the individual control of the liquid valve and of the control valves of each of said filling elements.

12. The system according to claim 11, wherein the control device opens the first and the second control valves for a preliminary flushing of the respective container chronologically prior to the actual filling phase and to the pre-pressurization from the source for the inert gas under pressure, with the liquid valve closed and the third control valve closed.

13. The system according to claim 12, wherein the control device opens the third control valve for a partial pre-pressurization of the respective container chronologically prior to the actual filling phase by means of the gas duct and the gas opening from the return gas collecting space, with the liquid valve closed and the first and second control valves closed.

14. The system according to claim 13, wherein the control device opens the first control valve and the second control valve for a preliminary pressurization of the container from the source for the inert gas via the filling tube with the liquid valve closed and the third control valve closed.

15. The system according to claim 14, wherein the control device opens the third control valve for a preliminary pressurization of the container via the gas duct and the gas duct opening from the source for the inert gas, with the liquid valve closed, and the first and second control valves closed.

16. The system according to claim 15, wherein the control device opens the third control valve in a preliminary depressurization and/or calming phase that chronologically follows the filling phase, with a closed liquid valve as well as closed first and second control valves.

17. The system according claim 16, wherein the control device opens the first control valve at the end of the filling to empty the filling tube into the respective container, with a closed liquid valve as well as closed second and third control valves.

18. The system according claim 17, wherein the control device for an equalization of the levels in the filling tube and in the container, still under return gas pressure but after the completion of the filling phase, opens the first and third control valves with the liquid valve closed and the second control valve closed, and the inert gas comprises $CO_2$ gas.

19. Filling element to fill containers with a liquid product under counter pressure, wherein chronologically prior to the actual filling phase, the interior of the container is pre-pressurized with an inert gas under pressure, and during the filling phase, the gas displaced from the container by the incoming product is contained under pressure by a return gas collecting space, and chronologically subsequent to the filling phase, the container is depressurized to atmospheric pressure by means of a depressurization duct, said filling element comprising:

at least one filling element;

a liquid duct realized in a housing of the filling element, which liquid duct forms a dispensing opening for the product and emerges above a filling tube that projects beyond an underside of the filling element;

with a liquid valve in the liquid duct which opens in the filling phase to fill the respective container placed with a container mouth on the filling element and closes again at the end of the filling phase;

with a gas duct that, when the container is fastened to the filling element, is in communication with the interior of the container by means of at least one gas duct opening that is offset with respect to the filling tube;

with first, second and third individually controllable control valves to control gas pathways that are realized in the housing, wherein a first control valve is in communication on an input side by means of a first gas pathway with an area of the liquid duct downstream of the liquid valve in the direction of flow of the product, and on an output side with a second gas pathway, a second control valve is in communication on the input side by means of a third gas pathway with a source for the inert gas under pressure, a third control valve is in communication on the input side by means of a third gas pathway with the gas duct and with a fourth gas pathway that has at least a first throttle for the depressurization, and is in communication on the output side by means of a fifth gas pathway that has at least one second throttle with the return gas collecting space;

wherein in a sixth gas pathway which connects the first control valve on the output side with the third control valve there is a first check valve which opens in a direction of flow from the third control valve to the first control valve, and closes for a flow in the opposite direction, and wherein in a gas pathway or bypass parallel to the at least one second throttle or nozzle there is a second check valve, which opens in a direction of flow from the return gas collecting chamber to the third control valve, and closes for a flow in the opposite direction.

20. Filling element according to claim 19, wherein the at least one first check valve can be switched so that it is inactive or removed to open the sixth gas pathway in both directions of flow, and the inert gas comprises $CO_2$ gas.

* * * * *

UNITED STATES PATENT AND TRADEMARK OFFICE

CERTIFICATE OF CORRECTION

PATENT NO. : 6,189,578 B1
DATED : February 20, 2001
INVENTOR(S) : Ludwig Clusserath It is certified that error appears in the above-identified patent and that said Letters Patent is hereby corrected as shown below:

Column 9, Table III,
First column, line 6, under "Process Step" after "and the gas", insert -- duct 14 --.

Signed and Sealed this

Nineteenth Day of March, 2002

*Attest:*

*Attesting Officer*

JAMES E. ROGAN
*Director of the United States Patent and Trademark Office*